US011380507B2

(12) United States Patent
Kawase et al.

(10) Patent No.: US 11,380,507 B2
(45) Date of Patent: Jul. 5, 2022

(54) SUBSTRATE SURFACE-MOUNTED FUSE

(71) Applicant: PACIFIC ENGINEERING CORPORATION, Ogaki (JP)

(72) Inventors: Fumiyuki Kawase, Ogaki (JP); Daiji Kondo, Ogaki (JP)

(73) Assignee: Pacific Engineering Corporation, Ogaki (JP)

( * ) Notice: Subject to any disclaimer, the term of this patent is extended or adjusted under 35 U.S.C. 154(b) by 0 days.

(21) Appl. No.: 17/289,171

(22) PCT Filed: Sep. 26, 2019

(86) PCT No.: PCT/JP2019/037786

§ 371 (c)(1),
(2) Date: Apr. 27, 2021

(87) PCT Pub. No.: WO2020/110443

PCT Pub. Date: Jun. 4, 2020

(65) Prior Publication Data

US 2021/0398764 A1 Dec. 23, 2021

(30) Foreign Application Priority Data

Nov. 26, 2018 (JP) ..... JP2018-220127

(51) Int. Cl.
*H01H 85/143* (2006.01)
*H01H 85/055* (2006.01)
(Continued)

(52) U.S. Cl.
CPC ..... *H01H 85/143* (2013.01); *H01H 85/055* (2013.01); *H01H 85/165* (2013.01); *H01H 85/20* (2013.01)

(58) Field of Classification Search
CPC .... H01H 85/055; H01H 85/12; H01H 85/143; H01H 85/165; H01H 85/20;
(Continued)

(56) References Cited

U.S. PATENT DOCUMENTS 4,394,639 A * 7/1983 McGalliard ..... H01R 13/68 337/292
7,701,321 B2 * 4/2010 Banzo ..... H05K 3/222 337/284
(Continued)

FOREIGN PATENT DOCUMENTS

JP 2016-207469 A 12/2016
WO 2013/125461 A1 8/2013

OTHER PUBLICATIONS

Japanese Patent Office; International Search Report dated Nov. 19, 2019, PCT Application No. PCT/JP2019/037786; (2019); pp. 1.

*Primary Examiner* — Jacob R Crum
(74) *Attorney, Agent, or Firm* — FisherBroyles LLP; Kevin D. Jablonski

(57) ABSTRACT

The present invention provides a substrate surface-mounted fuse that uses a replacement fuse to enable an electric circuit to be electrically connected simply and immediately even when a fuse part melts.

A substrate surface-mounted fuse 100 mounted on the surface of a substrate 300 comprises: a housing 110; a fuse part 120 that is disposed in the housing 110; and a terminal part 130 that is coupled to both ends of the fuse part 120 and exposed to the outside of the housing 110, wherein a portion of the terminal part 130 is provided with a fixed section 134 for fixing to the surface of the substrate 300 and is provided with an attachment part 140 enabling attachment of a terminal part 230 of a replacement fuse 200.

20 Claims, 7 Drawing Sheets

(51) Int. Cl.
*H01H 85/165* (2006.01)
*H01H 85/20* (2006.01)

(58) Field of Classification Search
CPC ..... H01H 2085/206; H01H 2085/2075; H01H 2085/208; H01H 2085/2085; H01H 2085/209
See application file for complete search history.

(56) References Cited

U.S. PATENT DOCUMENTS

| | | | | |
|---|---|---|---|---|
| 7,714,693 | B2 * | 5/2010 | Miyamoto | H01H 85/24 337/186 |
| 2003/0166352 | A1 * | 9/2003 | Oh | H01H 85/2035 439/250 |
| 2004/0196135 | A1 | 10/2004 | Clair | |
| 2008/0030294 | A1 | 2/2008 | Jozwiak | |

* cited by examiner

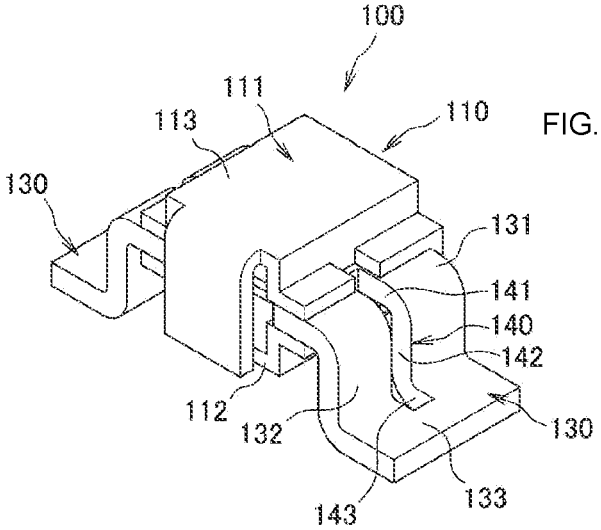
FIG. 1A
FIG. 1B
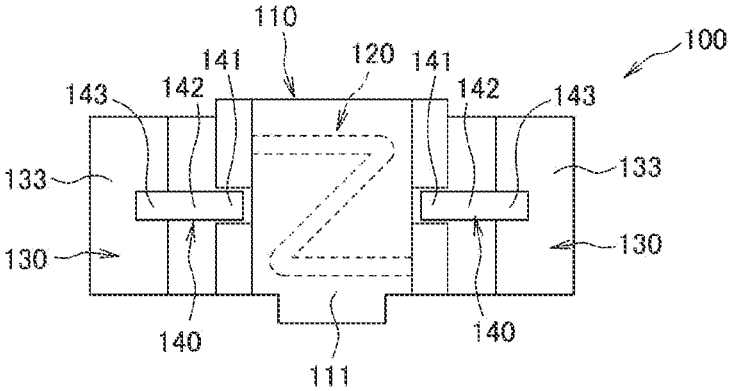

SUBSTRATE SURFACE-MOUNTED FUSE

TECHNICAL FIELD

The present invention mainly relates to a fuse which is used in an electric circuit for an automobile or the like, and particularly relates to a substrate surface-mounted fuse which is mounted on a substrate surface.

BACKGROUND ART

Conventionally, a fuse has been used to protect an electric circuit which is installed in an automobile or the like, and various electrical components which are connected to the electric circuit. More precisely, when an unintended overcurrent flows in an electric circuit, a fuse part of a fuse element built into the fuse melts under the heat generated by the overcurrent, thereby protecting the various electrical components by preventing excess current from flowing.

Further, there are various types of this fuse, and the substrate surface-mounted fuse mounted on a substrate surface as illustrated in Patent Literature 1 has been known, for example. When this substrate surface-mounted fuse is also used on a fuse box substrate, the fuse box and substrate can be miniaturized, and the manufacturing process can also be simplified. However, because this substrate surface-mounted fuse is fixed to the substrate surface using solder or the like, when an abnormality in the electric circuit arises and the fuse part of the substrate surface-mounted fuse melts, replacement of the substrate with another substrate has been necessary. Hence, there is a problem in that, until the substrate is replaced with another substrate, the electric circuit remains interrupted and the electric circuit or the like and the various electrical components installed in an automobile or the like do not function.

CITATIONS LIST

Patent Literature

Patent Literature 1: Japanese Patent Laid-Open Application No. 2016-134317.

SUMMARY OF INVENTION

Technical Problems

Therefore, the present invention provides a substrate surface-mounted fuse that uses a replacement fuse to enable an electric circuit to be electrically connected simply and immediately even when a fuse part melts.

Solutions to Problems

The substrate surface-mounted fuse of the present invention is a substrate surface-mounted fuse which is mounted on the surface of a substrate and includes: a housing; a fuse part that is disposed in the housing; and a terminal part that is coupled to both ends of the fuse part and exposed to the outside of the housing, wherein a portion of the terminal part is provided with a fixed part for fixing to the surface of the substrate and is provided with an attachment part enabling attachment of a terminal part of a replacement fuse.

According to the foregoing features, the terminal part of a replacement fuse can be attached to the attachment part of the terminal part of the substrate surface-mounted fuse, and hence, even when the fuse part of the substrate surface-mounted fuse melts and the electric circuit is interrupted, a replacement fuse can be used to electrically connect and restore the electric circuit simply and immediately. As a result, an electric circuit or the like and various electrical components which are installed in an automobile or the like can be immediately made to function normally, In the substrate surface-mounted fuse of the present invention, the attachment part is configured for insertion and attachment of the terminal part of the replacement fuse.

According to the foregoing feature, because the attachment part is constituted for insertion of the terminal part of a replacement fuse, the attachment part possesses superior workability for facilitating attachment of the replacement fuse to the substrate surface-mounted fuse. Moreover, because the terminal part of the replacement fuse is inserted in the attachment part, the replacement fuse can be readily removed from the substrate surface-mounted fuse and stably attached thereto.

In the substrate surface-mounted fuse of the present invention, the attachment part is positioned on the same surface as an upper surface of the housing or below the upper surface.

According to the foregoing feature, the whole of the substrate surface-mounted fuse can be made compact, thereby contributing to substrate miniaturization.

In the substrate surface-mounted fuse of the present invention, the attachment part is positioned above the upper surface of the housing.

According to the foregoing feature, because the attachment part is positioned above the upper surface of the housing, interference between the replacement fuse and the substrate surface-mounted fuse can be prevented and the replacement fuse can be reliably attached to the substrate surface-mounted fuse.

Advantageous Effects of Invention

As mentioned earlier, according to the substrate surface-mounted fuse of the present invention, a replacement fuse can be used to electrically connect an electric circuit simply and immediately even when a fuse part melts.

BRIEF DESCRIPTION OF DRAWINGS

FIG. 1(*a*) is an overall perspective view of a substrate surface-mounted fuse according to a first embodiment of the present invention, and FIG. 1(*b*) is a plan view of the substrate surface-mounted fuse.

FIG. 2(*b*) is a side elevation of the substrate surface-mounted fuse; and FIG. 2(*c*) is a bottom elevation of the substrate surface-mounted fuse.

FIG. 3(*b*) is an overall perspective view of a state in which the substrate surface-mounted fuse according to the first embodiment of the present invention is mounted on a substrate.

FIG. 5(*b*) is an enlarged side elevation of the state.

FIG. 6(*b*) is a front elevation of the substrate surface-mounted fuse; and FIG. 6(*c*) is a plan view of the substrate surface-mounted fuse.

FIG. 7(*b*) is a front elevation of the substrate surface-mounted fuse; and FIG. 7(*c*) is a plan view of the substrate surface-mounted fuse.

REFERENCE SIGNS LIST

Figure 2A:
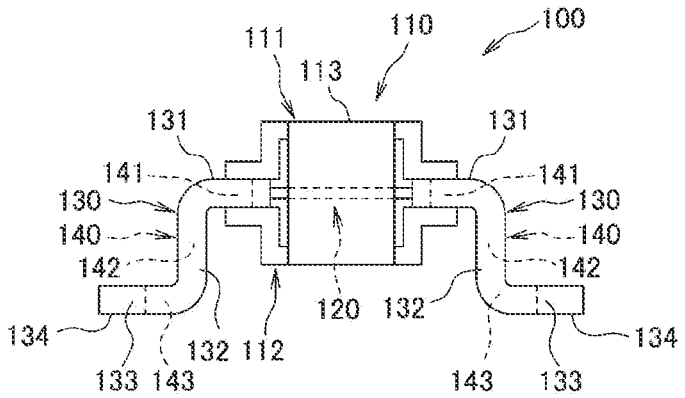
FIG. 2(*a*) is a front elevation of the substrate surface-mounted fuse according to the first embodiment of the present invention.

100 Substrate surface-mounted fuse
110 Housing
120 Fuse part
130 Terminal part
134 Fixed part
200 Replacement fuse
230 Terminal part
300 Substrate

DESCRIPTION OF EMBODIMENTS

Embodiments of the present invention will be described hereinbelow using the drawings. Nate that the shape and material properties and the like of each member of a substrate surface-mounted fuse according to the embodiments described hereinbelow are illustrative examples and the present invention is not limited to or by such shapes and material properties and the like. Note that, in the present specification, as illustrated. in FIGS. 3 to 5, "upward direction" is an upward direction along a direction that intersects the horizontal direction at right angles, that is, along a vertical direction, in a state where a substrate surface-mounted fuse 100 is fixed to the surface of a substrate 300 which extends horizontally, "downward direction" is downward direction along the vertical direction, "longitudinal direction" is a direction along the vertical direction, and "lateral direction" is a direction along the horizontal direction.

First Embodiment

Figure 2B:
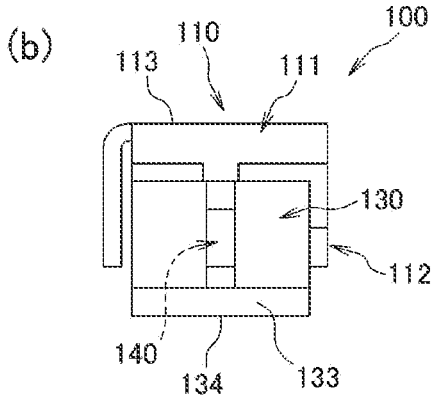
Figure 2C:
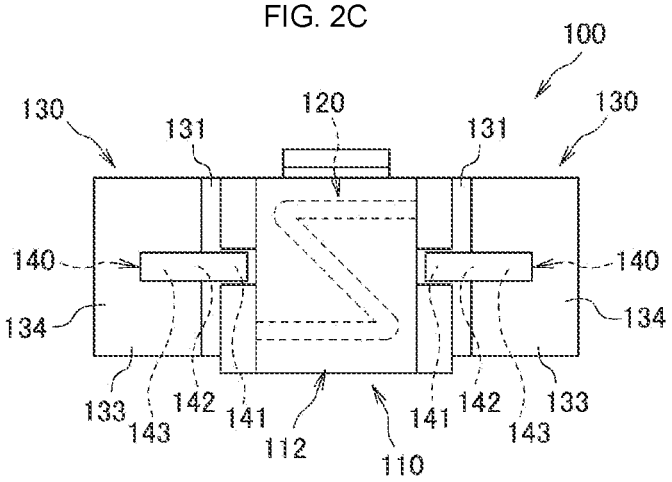

First, the substrate surface-mounted fuse 100 according to a first embodiment of the present invention is illustrated in FIGS. 1 and 2. FIG. 1(*a*) is an overall perspective view of a substrate surface-mounted fuse 100; FIG. 1(*b*) is a plan view of the substrate surface-mounted fuse 100; FIG. 2(*a*) is a front elevation of the substrate surface-mounted fuse 100; FIG. 2(*b*) is a side elevation of the substrate surface-mounted fuse 100; and FIG. 2(*c*) is a bottom elevation of the substrate surface-mounted fuse 100.

The substrate surface-mounted fuse 100 includes a substantially rectangular parallelepiped-shaped housing 110; a fuse part 120 that is disposed in the housing 110; and a terminal part 130 that extends outside the housing 110. The housing 110 is formed having a substantially rectangular parallelepiped shape from an insulating synthetic resin, the interior of which is a cavity. Further, the fuse part 120 is disposed in an internal space of the housing 110, and a terminal part 130 made of metal is coupled to each of both sides of the fuse part 120. Furthermore, the terminal part 130 extends laterally from the side surfaces on both sides of the housing 110.

More specifically, the housing 110 is constituted from an upper housing 111 and a lower housing 112 which are vertically divided into two and covers the fuse part 120 so as to sandwich the same from above and below. Further, a flat upper end 131 of the terminal part 130 is coupled to both ends of the fuse part 120, and the upper end 131 extends to the outside from inside the housing 110. In addition, the terminal part 130 includes a middle section 132 which extends so as to bend downward from the upper end 131, and a flat lower end 133 that extends laterally from the middle section 132. Note that, although the housing 110 is constituted from the upper housing 111 and the lower housing 112 which are vertically divided into two, the housing 110 is not limited to this configuration and may be embodied such that the upper housing 111 and the lower housing 112 are integrally molded so as to be indivisible.

Furthermore, the fuse part 120 is formed having a thin and linear shape from a metal such as zinc alloy and is afforded the characteristic of melting when a predetermined overcurrent is flowing. Further, a terminal part 130 made of metal is a part which is electrically coupled to a substrate electrode (described subsequently), and when an overcurrent is flowing in the electric circuit connected to the substrate, the fuse part 120 melts, thereby interrupting the circuit. Note that the fuse part 120 is not limited to the shape and configuration illustrated in FIGS. 1 and 2, rather, as long as the fuse part is afforded the characteristic of melting when a predetermined overcurrent is flowing, the same may have another shape and configuration.

Furthermore, an attachment part 140 in the form of a through-hole that extends so as to be vertically long in an up-down direction is provided to each of the terminal parts 130 on both sides. Furthermore, the attachment part 140 is positioned below an upper surface 113 of the housing 110. The attachment part 140 is shaped so as to pass through from the surface of the terminal part 130 to the back face thereof to enable insertion of a terminal part 230 of a replacement fuse 200 (described subsequently). More specifically, the attachment part 140 is constituted from an upper end hole 141 that extends in a lateral direction in the upper end 131 of the terminal part 130; a middle hole 142 that extends in a vertical direction in the middle section 132; and a lower end hole 143 that extends in a lateral direction in the lower end 133. The upper end hole 141, middle hole 142, and lower end hole 143 pass through from the surface of the terminal part 130 to the back face thereof.

Furthermore, the back-face side of the lower end 133 of the terminal part 130 is a fixed part 134 which is fixed using solder or the like to the surface of the substrate (described subsequently), and the fixed part 134 is a flat surface, and hence readily adheres to the substrate surface.

Note that the attachment part 140 is positioned below the upper surface 113 of the housing 110 but is not limited to this position, rather, the attachment part 140 may be positioned on the same surface as the upper surface 113 of the housing 110. For example, the attachment part 140 may be formed so as to protrude upward from the terminal part 130, and the attachment part 140 protruding from the terminal part 130 is configured so as to be positioned on the same surface as the upper surface 113 of the housing 110.

Furthermore, although the back-face side of the lower end 133 of the terminal part 130 is the fixed part 134. the configuration is not limited thereto, rather, when the lower end 133 of the terminal part 130 is bent inside in the opposite direction from that of FIGS. 1 and 2, the surface side of the lower end 133 may be the fixed part 134. In addition, as illustrated in FIG. 1, the terminal part 130 is formed having the upper end 131, the middle section 132, and the lower end 133, but the configuration is not limited thereto, rather, any form and shape may be adopted as long as the terminal part can be fixed to the substrate surface.

Next, a state where the substrate surface-mounted fuse 100 is mounted on the substrate 300 will be described with reference to FIG. 3. Note that FIG. 3(*a*) is an overall perspective view of the substrate 300, and FIG. 3(*b*) is an overall perspective view of a state where the substrate surface-mounted fuse 100 is mounted on the substrate 300.

Figure 3A:
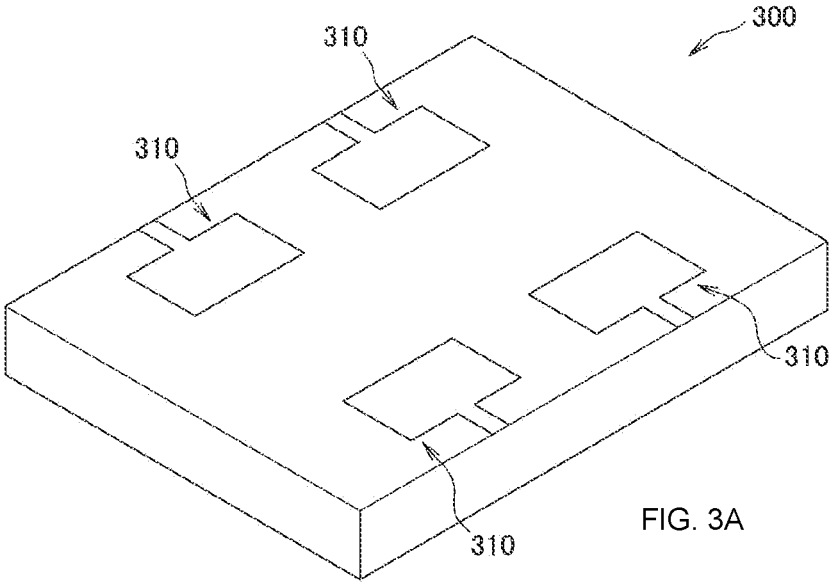
FIG. 3(*a*) is an overall perspective view of a substrate.
Figure 3B:
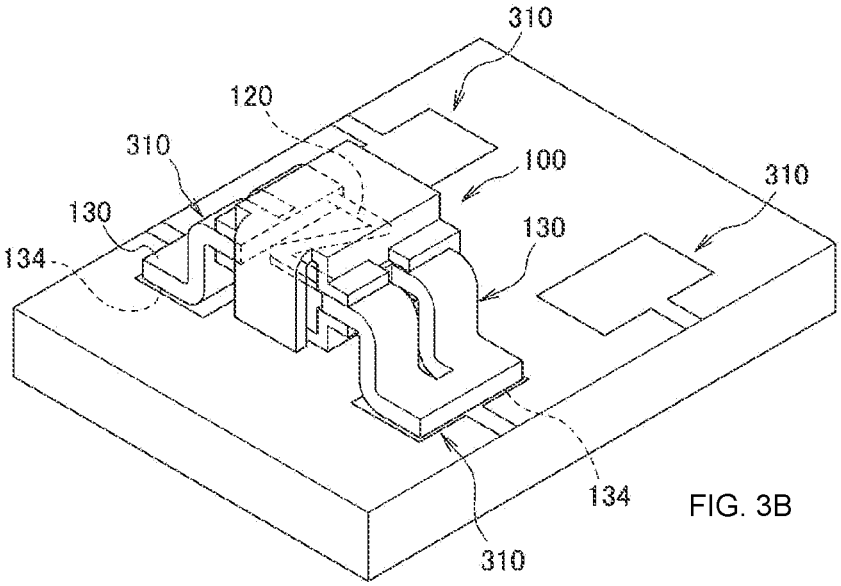

As illustrated in FIG. 3(a), the substrate 300 is provided to a part such as a fuse box and is electrically connected to an electric circuit installed in an automobile or the like. Further, a plurality of electrodes 310 connected to the electric circuit are provided on the surface of the substrate 300. As illustrated in FIG. 3(*b*), the substrate surface-mounted fuse 100 of the present invention fixes the fixed part l34 on the back-face side of the terminal part 130 of the substrate surface-mounted fuse 100 to the respective surfaces of the paired electrodes 310. More specifically, the substrate surface-mounted fuse 100 is mounted reliably on the substrate 300 by placing the flat fixed part 134 in close contact with the surface of the flat electrodes 310 and fixing the sections which are in close contact by using a method such as soldering. Note that, although this method of fixing the fixed part 134 to the substrate surface is adopted, any method such as fixing through adhesion using adhesive may be adopted in addition to soldering.

Further, when an abnormal overcurrent is flowing in the electric circuit connected to the electrodes 310, the fuse part 120 of the substrate surface-mounted fuse 100 melts and the electric circuit is interrupted, thereby protecting the various electrical components connected to the eclectic circuit. After the fuse part 120 of the substrate surface-mounted fuse 100 has melted, because the electric circuit then remains interrupted, the substrate surface-mounted fuse 100 must be replaced. However, because the substrate surface-mounted fuse 100 is fixed to the substrate 300, the former cannot be easily replaced. Therefore, although replacement with another substrate 300 has conventionally been handled, there has been the problem that preparation of a spare substrate 300 and replacement take time and that the electric circuit or the like and various electrical components installed in the automobile or the like do not function for some time.

Figure 4A:
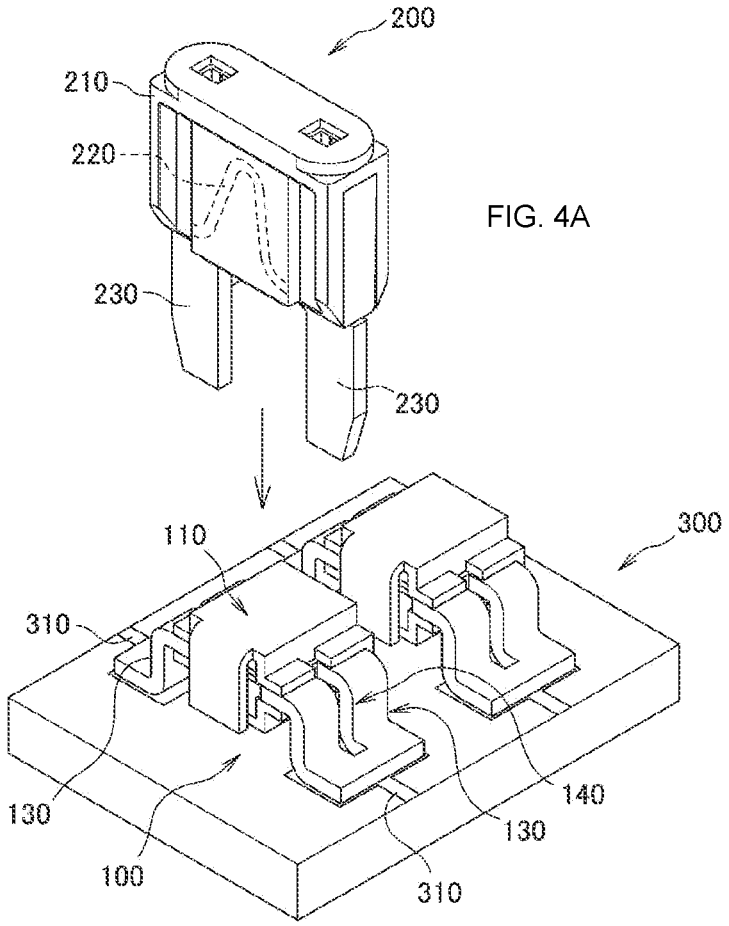
FIGS. 4(*a*) and 4(*b*) are overall perspective views of an aspect in which a replacement fuse is attached to the substrate surface-mounted fuse according to the first embodiment of the present invention.
Figure 4B:
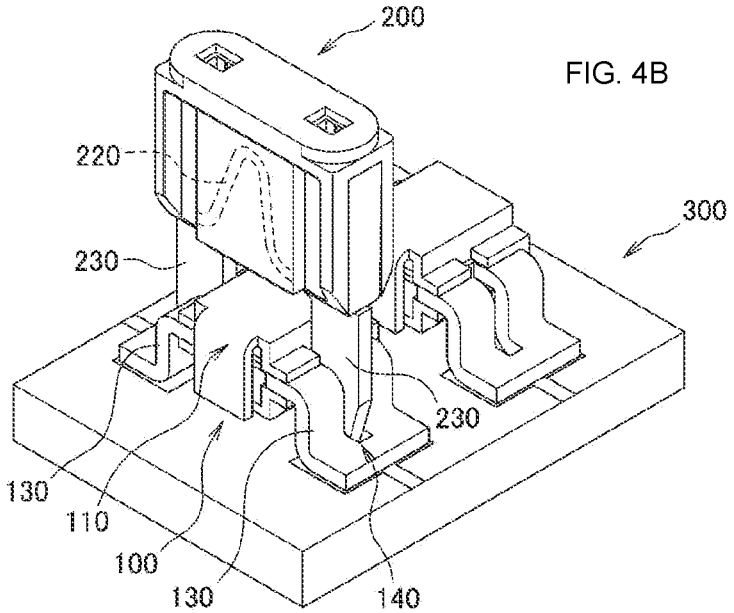
Figure 5A:
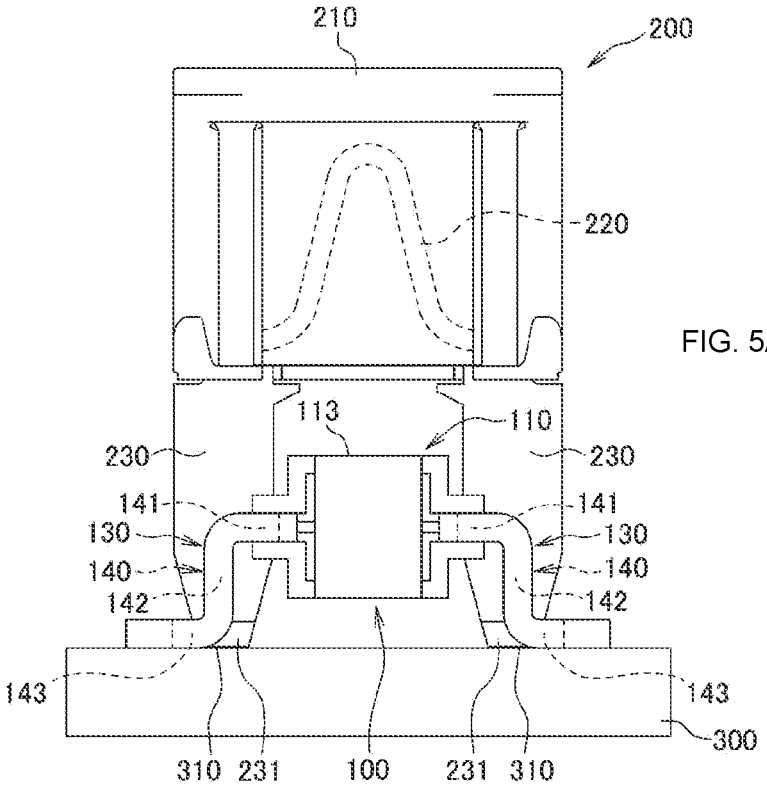
FIG. 5(*a*) is an enlarged front elevation of a state in which a replacement fuse is attached to a substrate surface-mounted fuse.
Figure 5B:
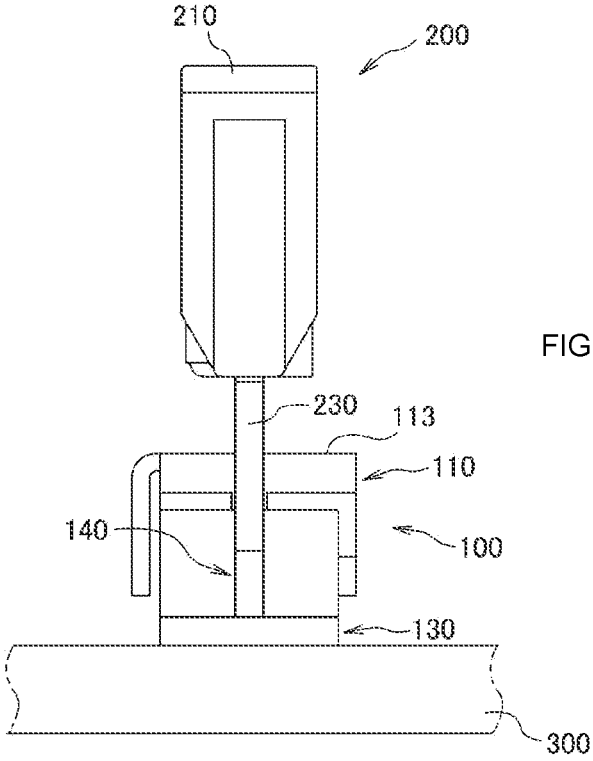

Therefore, in the case of the substrate surface-mounted fuse 100 of the present invention, a replacement fuse 200 can be used to electrically connect and restore a cut-off electric circuit simply and immediately, as illustrated in FIGS. 4 and 5. Note that FIGS. 4(*a*) and 4(*b*) are overall perspective views illustrating an aspect in which the replacement fuse 200 is attached to the substrate surface-mounted fuse 100; FIG. 5(*a*) is an enlarged front elevation of a state where the replacement fuse 200 is attached to the substrate surface-mounted fuse 100 and FIG. 5(*b*) is an enlarged side elevation of this state. Furthermore, the replacement fuse 200 is a conventionally known, so-called blade fuse and includes an insulating housing 210, a fuse part 220 which is housed in the housing 210, and terminal parts 230 made of metal which are coupled to the fuse part 220 and extend from the underside of the housing 210.

As illustrated in FIG. 4. the terminal parts 230 of the replacement fuse 200 are attached from above to the attachment parts 140 of the terminal parts 130 of the substrate surface-mounted fuse 100. Thus, because the terminal parts 130 are electrically coupled to the terminal parts 230 of the replacement fuse 200, the pair of electrodes 310 on both sides are electrically connected by the replacement fuse 200, enabling the electric circuit coupled to the electrodes 310 to be electrically connected. Further, when an abnormal overcurrent is flowing in an electric circuit installed in an automobile or the like, the fuse part 220 of the replacement fuse 200 melts and the electric circuit is interrupted, thereby protecting the various electrical components connected to the electric circuit.

Thus, according to the substrate surface-mounted fuse 100 of the present invention, the terminal parts 230 of the replacement fuse 200 can be attached to the attachment parts 140 of the terminal parts 130 of the substrate surface-mounted fuse 100, and hence, even when the fuse part 120 of the substrate surface-mounted fuse 100 melts and the electric circuit is interrupted, the replacement fuse 200 can be used to electrically connect and restore the electric circuit simply and immediately. As a result, an electric circuit or the like and various electrical components which are installed in an automobile or the like can be immediately made to function normally.

In addition, according to the substrate surface-mounted fuse 100 of the present invention, the attachment parts 140 are configured for insertion of the terminal parts 230 of the replacement fuse 200, and hence the attachment parts possess superior workability for facilitating attachment of the replacement fuse 200 to the substrate surface-mounted fuse 100, Moreover, because the terminal parts 230 of the replacement fuse 200 are inserted in the attachment parts 140, the replacement fuse 200 can be readily removed from the substrate surface-mounted fuse 100 and stably attached thereto.

In addition, the attachment parts 140 extend in a longitudinal shape in an up-down direction, and hence the plate-shaped terminal parts 230 that extend in a longitudinal shape in an up-down direction can be reliably supported to avoid tipping. In particular, the housing 110 of the substrate surface-mounted fuse 100 is thick in an up-down direction on account of housing the fuse part 120. To this end, the terminal parts 130 which are coupled to both ends of the fuse part 120 include a vertically long section (the middle section 132, for example) that extends from the side of the housing 110 to below the housing 110 so as to enable coupling with the electrodes 310 of the substrate 300. Further, as long as the attachment parts 140 are provided along the vertically long section, the longitudinal plate-shaped terminal part 230 can be reliably supported to avoid tipping, and hence the vertically long section of the terminal parts 130 is used effectively.

Furthermore, the attachment parts 140 are shaped as a vertically long through-hole, but the width of the through-hole section is the same as the thickness of the terminal parts 230 or slightly narrower than the thickness of the terminal parts 230, and hence the attachment parts 140 are capable of gripping the inserted terminal parts 230 such that the same are held from both sides. Hence, the replacement fuse 200 is firmly attached to the substrate surface-mounted fuse 100. Further, the attachment parts 140 include an upper end hole 141 that extend laterally, a middle hole 142 that extends vertically, and a lower end hole 143 that extends laterally, therefore enabling the surface area in contact with the terminal part 230 to be extended and enabling the replacement fuse 200 to be supported more stably. In addition, tips 231 of the terminal parts 230 pass through the lower end holes 143 of the attachment parts 140 and make contact with the surface of the electrodes 310, thereby enhancing the reliability of the connection between the terminal parts 230 and the electrodes 310.

Furthermore, the attachment parts 140 are positioned on the same surface as the upper surface 113 of the housing 110 or below the upper surface 113, and therefore the whole of the substrate surface-mounted fuse 100 can be made compact, contributing to miniaturization of the substrate 300. In addition, the attachment parts 140 are provided to the terminal parts 130 disposed on both sides of the housing 110 of the substrate surface-mounted fuse 100, and hence, as illustrated in FIGS. 4 and 5, the terminal parts 230 of the replacement fuse 200 are attached to the respective attachment parts 140 so as to straddle the housing 110 of the substrate surface-mounted fuse 100. Further, because attachment with straddling of the substrate surface-mounted fuse 100 is possible, that is, attachment with vertical stacking to the substrate surface-mounted fuse 100 to which the replacement fuse 200 is to be attached, work is intuitive and obvious to an operator or it is easy to recognize which substrate surface-mounted fuse 100 the replacement fuse 200 is attached to. More particularly, the substrate 300 is small and there is a concentration of the various electronic components and electrodes on the surface thereof, and hence it is easily recognized which substrate surface-mounted fuse 100 the replacement fuse 200 is attached to and a substrate surface-mounted fuse 100 requiring replacement is easily discriminated.

Furthermore, the configuration is such that the attachment parts 140 are integral to the terminal parts 130 and make contact with the terminal parts 230 of the replacement fuse 200, and the terminal parts 230 are directly fixed by the attachment parts 140 themselves, thereby preventing poor contact between the terminal parts 130 and 230 and enhancing contact reliability.

Note that, because the attachment parts 140 are formed as through-holes in the terminal parts 130 as illustrated in FIGS. 4 and 5, there is no need to separately provide a member for attaching the terminal parts 230 of the replacement fuse 200 and there is no need to significantly change the shape of the terminal parts 130, thereby also allow to facilitate manufacturing and reduce manufacturing costs.

Furthermore, despite taking the form of a through-hole as illustrated in FIGS. 4 and 5, the attachment parts 140 are not limited to said form and may instead take another form as long as the same is configured to enable attachment of the terminal parts 230 of the replacement fuse 200; for example, a form in which the tips of the terminal parts 230 are fixed using a bolt or the like to the terminal parts 130, a form such as a recess in which the tip of the terminal parts 230 are fitted, or another form, is possible. However, the replacement fuse 200 can be readily attached as long as the attachment parts 140 are configured for insertion and attachment of the terminal parts 230 of the replacement fuse 200, which is extremely useful. Furthermore, the configuration of the attachment parts 140 for insertion and attachment of the terminal parts 230 of the replacement fuse 200 is not limited to the form of a vertically long through-hole as illustrated in FIGS. 4 and 5, rather, a groove shape or the like as described subsequently, for example, is also possible, and any shape and configuration may be adopted as long as insertion and attachment of the terminal parts 230 of the replacement fuse 200 is feasible. Note that the replacement fuse 200 is in the form of a so-called blade fuse but not limited thereto, rather, other fuse forms may be implemented as long as the configuration includes an insulating housing, a fuse part which is housed in the housing, and a terminal part made of metal which is coupled to the fuse part and extends from the housing.

Second Embodiment

Figure 6A:
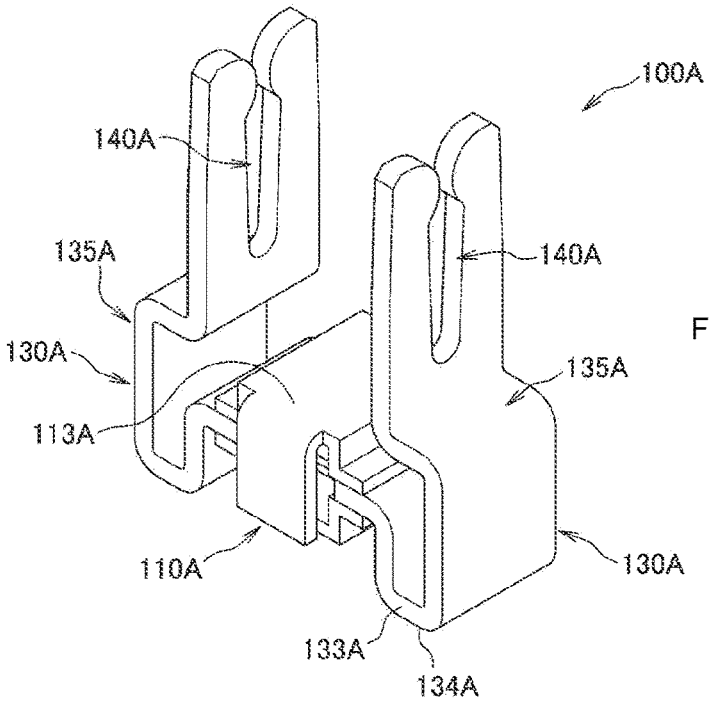
FIG. 6(*a*) is an overall perspective view of the substrate surface-mounted fuse according to a second embodiment of the present invention.
Figure 6B:
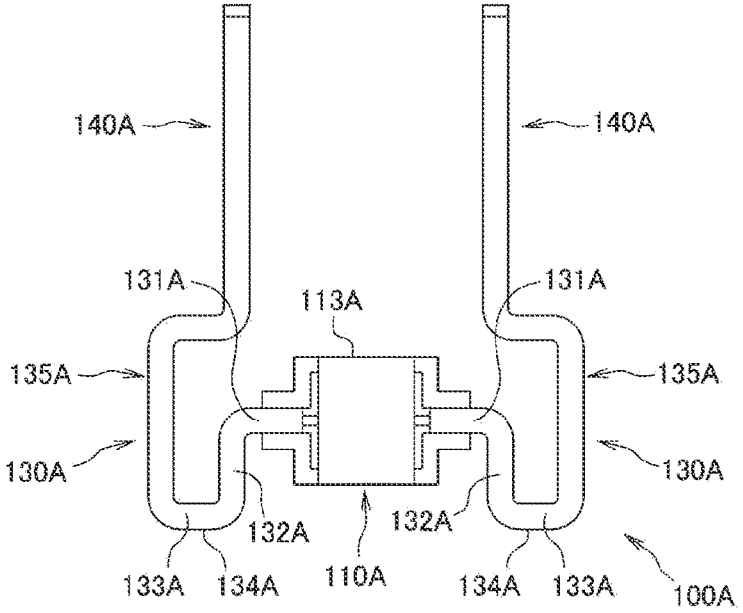
Figure 6C:
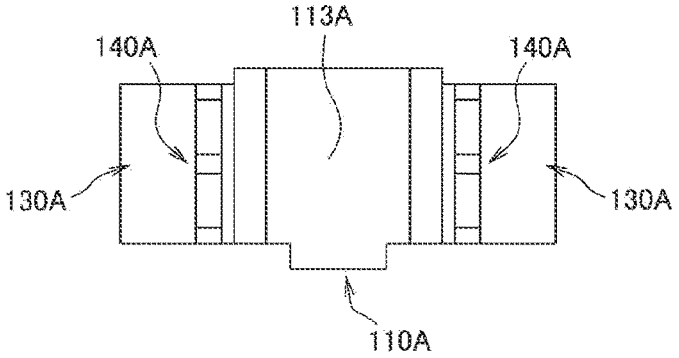

Next, a substrate surface-mounted fuse 100.E of the present invention according to a second embodiment will be described with reference to FIG. 6. Note that FIG. 6(*a*) is an overall perspective view of the substrate surface-mounted fuse 100A of the present invention according to the second embodiment; FIG. 6(*b*) is a front elevation of the substrate surface-mounted fuse 100A, and FIG. 6(*c*) is a plan view of the substrate surface-mounted fuse 100A. Furthermore, except for the configurations of the terminal parts 130A and the attachment parts 140A, the configurations of the substrate surface-mounted fuse 100A according to the second embodiment are basically the same as the configurations of the substrate surface-mounted fuse 100 according to the first embodiment, and hence descriptions of identical configurations are omitted.

As illustrated in FIG. 6, the terminal parts 130A include an upper end 131A that extends from the side surface of a housing 110A, a middle section 132. that extends so as to bend downward from the upper end 131A, a flat lower end 133A that extends laterally from the middle section 132A, and an upward extension section 135A that extends upward from the lower end 133A. In addition, the back-face side of the lower end 133A is a fixed part 134A that is fixed to the substrate surface. Furthermore, the tip of the upward extension section 135A is divided into two parts between which a groove-shaped attachment part 140A is formed. The attachment part 140A at the tip of the upward extension section 135A takes the form of a so-called tuning fork, and the terminal parts 230 of the replacement fuse 200 can be attached to the attachment parts 140A by being inserted therein. Further, the attachment parts 140A are positioned above the upper surface 113A of the housing 110A, and hence interference between the replacement fuse 200 and the substrate surface-mounted fuse 100A can be prevented, and the replacement fuse 200 can be reliably attached to the substrate surface-mounted. fuse 100A. For example, in a case where the housing 210 of the replacement fuse 200 interferes with the housing 110A of the substrate surface-mounted fuse 100A when the length of the terminal parts 230 of the replacement fuse 200 is short and the terminal parts 230 are inserted in the attachment parts 140, interference between the replacement fuse 200 and the substrate surface-mounted fuse 100 can be effectively prevented by raising the position of the attachment parts 140A.

Third Embodiment

Figure 7A:
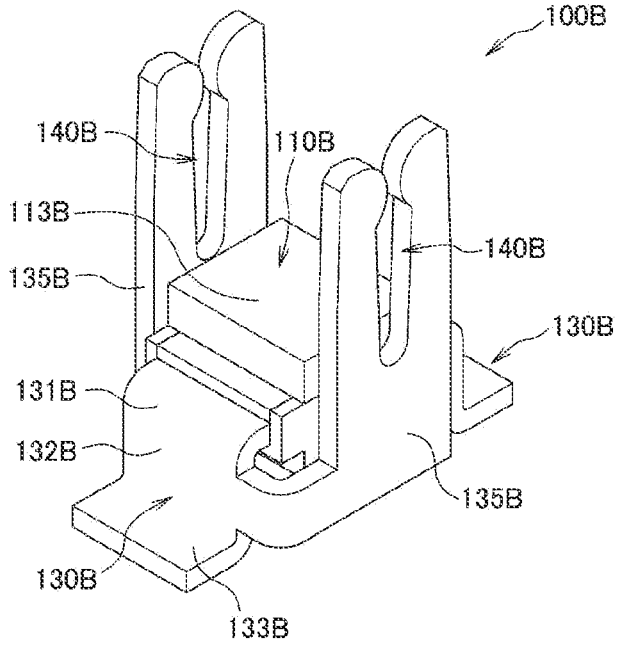
FIG. 7(*a*) is an overall perspective view of the substrate surface-mounted fuse according to a third embodiment of the present invention.
Figure 7B:
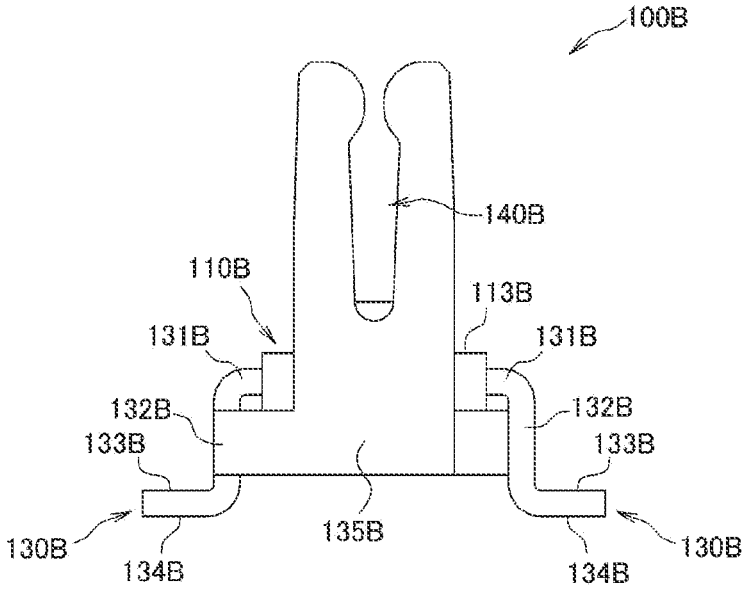
Figure 7C:
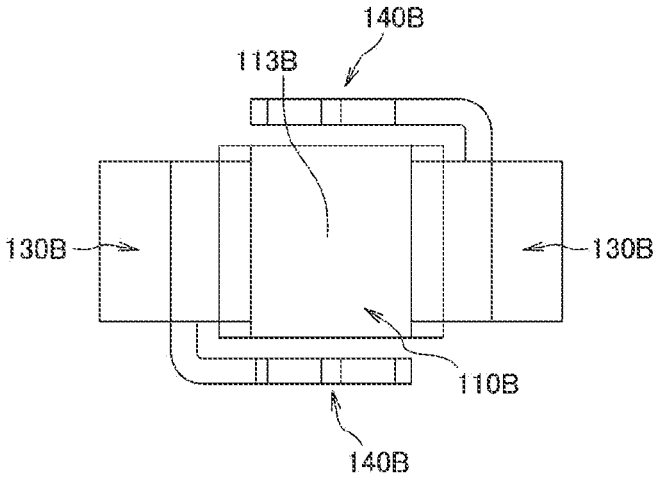

A substrate surface-mounted fuse 100E of the present invention according to a third embodiment will be described next with reference to FIG. 7. Note that FIG. 7(*a*) is an overall perspective view of the substrate surface-mounted fuse 1.00B of the present invention according to the third embodiment; FIG. 7(*b*) is a front elevation of the substrate surface-mounted fuse 100B; and FIG. 7(*c*) is a plan view of the substrate surface-mounted fuse 100B. Furthermore, except for the configurations of terminal parts 130B and attachment parts 140B, the configurations of the substrate surface-mounted fuse 100B according to the third embodiment are basically the same as the configurations of the substrate surface-mounted fuse 100 according to the first embodiment, and hence descriptions of identical configurations are omitted.

As illustrated in FIG. 7, the terminal part 130B includes an upper end 131B that extends from the side surface of a housing 110B, a middle section 132B that extends so as to bend downward from the upper end 131B, a flat lower end 133B that extends laterally from the middle section 132B, and an upward extension section 135B that bends in a direction intersecting the direction of extension of the terminal part 130B from the middle section 132B and extends upward. In addition, the back-face side of the lower end 133B is the fixed part 134B that is fixed to the substrate surface. Furthermore, the tip of the upward extension section 135B is divided into two parts between which a groove-shaped attachment part 140B is formed. The attachment part 140B at the tip of the upward extension section 135B takes the form of a so-called tuning fork, and the terminal part 230 of the replacement fuse 200 can be attached to the attachment part 140B by being inserted therein. Further, the attachment part 140B is positioned above the upper surface 113B of the housing 110B, and hence interference between the replacement fuse 200 and the substrate surface-mounted fuse 100 can be prevented, and the replacement fuse 200 can be reliably attached to the substrate surface-mounted fuse 100. In addition, the orientation of the attachment parts 140B is changed to a direction intersecting the direction of extension of the terminal parts 130B, and hence the attachment orientation of the replacement fuse 200 can be changed.

Note that the substrate surface-mounted fuse of the present invention is not limited to the foregoing embodiment examples, rather, various modification examples and combinations are possible within the scope of the patent claims and the scope of the embodiments, and the modification examples and combinations are included in the scope of rights thereof.

The invention claimed is:

1. A substrate surface-mounted fuse, comprising:

a housing;

a fuse part disposed in the housing, the fuse part having a first end and a second end; and a terminal part coupled to the first end and the second end of the fuse part and exposed to the outside of the housing, wherein a portion of the terminal part comprises a fixed section coupled to the surface of the substrate and an attachment part configured to be attached to a terminal part of a replacement fuse.

2. The substrate surface-mounted fuse according to claim 1, wherein the attachment part is further configured for insertion and attachment of the terminal part of the replacement fuse.

3. The substrate surface-mounted fuse according to claim 1, wherein the attachment part is disposed on the same surface as an upper surface of the housing.

4. The substrate surface-mounted fuse according to claim 1, wherein the attachment part is disposed above the upper surface of the housing.

5. The substrate surface-mounted fuse according to claim 1, wherein the attachment part is disposed below an upper surface of the housing.

6. A fuse assembly configured to be mounted to a surface of a substrate, the fuse assembly comprising:

a housing having a cavity;

a fuse disposed in the cavity of the housing, the fuse having a first end and a second end; and a first fuse terminal assembly having a mount configured to be mounted to a substrate, the first fuse terminal assembly coupled to the first end of the fuse and disposed outside of the housing, the first fuse terminal assembly further comprising an attachment assembly configured to be coupled to a removable replacement fuse; and a second fuse terminal assembly having a mount configured to be mounted to the substrate, the second fuse terminal assembly coupled to the second end of the fuse and disposed outside of the housing, the second fuse terminal assembly further comprising an attachment assembly configured to be coupled to the removable replacement fuse.

7. The fuse assembly of claim 6, wherein the housing further comprises a parallel-piped housing shape.

8. The fuse assembly of claim 6, wherein the housing further comprises an insulating synthetic resin.

9. The fuse assembly of claim 6, wherein the housing further comprises:

an upper housing portion having a first U-shaped body; and a lower housing portion having a second U-shaped body;

wherein the first U-shaped body of the upper housing is configured to engage the U-shaped body of the lower housing portion forming the cavity.

10. The fuse assembly of claim 6, wherein the fuse is further configured to melt when exposed to a threshold electric current.

11. The fuse assembly of claim 6, wherein the attachment assembly of the first fuse terminal assembly and the attachment assembly of the second fuse terminal assembly each comprise biased receptacles configured to secure an insertable portion of the replacement fuse.

12. The fuse assembly of claim 6, wherein the fuse electrically couples the first terminal fuse assembly to the second terminal fuse assembly.

13. The fuse assembly of claim 6, wherein the replacement fuse, when inserted, electrically couples the first terminal fuse assembly to the second terminal fuse assembly.

14. The fuse assembly of claim 6, wherein the fuse comprises a non- linear shape.

15. An electric circuit for an automobile, the circuit comprising:

a substrate; and a fuse assembly mounted to a surface of a substrate, the fuse assembly comprising:

a housing having a cavity;

a fuse disposed in the cavity of the housing, the fuse having a first end and a second end; and a first fuse terminal assembly having a mount configured to be mounted to a substrate, the first fuse terminal assembly coupled to the first end of the fuse and disposed outside of the housing, the first fuse terminal assembly further comprising an attachment assembly configured to be coupled to a removable replacement fuse; and a second fuse terminal assembly having a mount configured to be mounted to the substrate, the second fuse terminal assembly coupled to the second end of the fuse and disposed outside of the housing, the second fuse terminal assembly further comprising an attachment assembly configured to be coupled to the removable replacement fuse.

16. The circuit of claim 15, further comprising:

a second fuse assembly mounted to the surface of the substrate, the second fuse assembly comprising:

a housing having a cavity;

a fuse disposed in the cavity of the second housing, the fuse having a first end and a second end; and a first fuse terminal assembly having a mount configured to be mounted to a substrate, the first fuse terminal assembly coupled to the first end of the fuse and disposed outside of the housing, the first fuse terminal assembly further comprising an attachment assembly configured to be coupled to a removable replacement fuse; and a second fuse terminal assembly having a mount configured to be mounted to the substrate, the second fuse terminal assembly coupled to the second end of the fuse and disposed outside of the housing, the second fuse terminal assembly further comprising an attachment assembly configured to be coupled to the removable replacement fuse.

17. The circuit of claim 15, further comprising a plurality of electrodes disposed on the surface of the substrate, each electrode suited to engage the mount of one of the first and second fuse terminal assemblies of the fuse assembly.

18. The circuit of claim 15, wherein the housing further comprises:

an upper housing portion having a first U-shaped body; and a lower housing portion having a second U-shaped body;

wherein the first U-shaped body of the upper housing is configured to engage the U-shaped body of the lower housing portion forming the cavity.

19. The circuit of claim 15, wherein the fuse is further configured to melt when exposed to a threshold electric current.

20. The circuit of claim 15, wherein the attachment assembly of the first fuse terminal assembly and the attachment assembly of the second fuse terminal each comprise biased receptacles configured to secure an insertable portion of the replacement fuse.

* * * * *